US008692098B1

(12) United States Patent
Reinhard

(10) Patent No.: US 8,692,098 B1
(45) Date of Patent: Apr. 8, 2014

(54) LEG LEVER ADJUSTMENT DEVICE FOR HI-HAT MUSICAL CYMBALS

(71) Applicant: Christopher S. Reinhard, New York, NY (US)

(72) Inventor: Christopher S. Reinhard, New York, NY (US)

( * ) Notice: Subject to any disclaimer, the term of this patent is extended or adjusted under 35 U.S.C. 154(b) by 0 days.

(21) Appl. No.: 13/815,383

(22) Filed: Feb. 26, 2013

(51) Int. Cl.
*G10D 13/02* (2006.01)

(52) U.S. Cl.
USPC ..... 84/422.3

(58) Field of Classification Search
USPC ..... 84/422.1, 422.2, 422.3, 421
See application file for complete search history.

(56) References Cited

U.S. PATENT DOCUMENTS

| | | | |
|---|---|---|---|
| 4,497,238 | A | 2/1985 | Dasovich |
| 5,218,151 | A | 6/1993 | Kurosaki |
| 5,367,939 | A | 11/1994 | Barker |
| 6,307,137 | B1 | 10/2001 | Liao |
| 6,316,708 | B1 | 11/2001 | Kuppers |
| 6,878,868 | B2 | 4/2005 | McMillan |
| 2012/0210843 | A1 | 8/2012 | Sato |

*Primary Examiner* — Kimberly Lockett

(57) ABSTRACT

A leg lever adjustment device for a hi-hat musical cymbals device to enable variable adjustment of spacing between an upper cymbal and lower cymbal without the need for hand or foot operation, includes: a) a base support having a connector mechanism for attachment to a hi-hat cymbals device vertical tube; b) a spring-biased cymbal arm rotatably attached to the base support, moveably positioned above the base support; c) a spring so as to bias the cymbal arm upwardly; d) a leg lever connected to the cymbal arm. A user may attach the leg lever adjustment device to a hi-hat such that in the leg lever rest position, the cymbal arm pushes the lower cymbal toward the upper cymbal, and by pressing the leg lever with a leg, pushes the lower cymbal down and away from the upper cymbal to alter impact sound.

20 Claims, 8 Drawing Sheets

LEG LEVER ADJUSTMENT DEVICE FOR HI-HAT MUSICAL CYMBALS

BACKGROUND OF INVENTION a. Field of Invention

The invention relates generally to hi-hat musical cymbals, and specifically to an adjustment device with variable spacing capabilities between an upper and lower cymbal. Importantly, the device is primarily operated by lateral leg movement, keeping the hands and feet of the drummer free to perform conventional drumming functions while simultaneously operating the present invention device. The present invention leg lever adjustment device may be positioned at its rest position wherein the cymbals are together, at its fully compressed position, wherein the cymbals having maximum spacing, or anywhere in between these extremes, depending upon the movement and positioning of the drummer's leg against the leg lever. The device is a stand-alone device, for attachment to a hi-hat device or it could be a component of a hi-hat device when the hi-hat device is constructed/assembled.

b. Description of Related Art

The following patents and applications are representative of various types of hi-hat devices:

United States Patent Application No. 2012/0210843 A1 to Naoki, described as a hi-hat bottom supporting a bottom cymbal, through which a rod is passed, from below in a state fixed to the upper end of an upper pipe via a retainer. The hi-hat bottom has the retainer, a receiving plate, a compression coil spring, and a lock nut. When a foot plate is depressed, the compression coil spring urges a top cymbal and a bottom cymbal in such a direction that the cymbals contact each other. When the foot plate is not depressed, the bottom cymbal is inclined, together with the receiving plate, at a predetermined inclination angle with respect to a horizontal plane by the urging force of the compression coil spring.

U.S. Pat. No. 6,878,868 B2 to McMillan describes a combination of a portable high-hat cymbal device and a drum that includes a drum cylinder-terminated at least on one end by a circular rim and having a drum head stretched thereover to create a drum noise when struck by a drum stick operated by a drummer. First and second cymbals are held in opposed formation near the rim of the drum and within reach of the drumsticks held in the hands of the drummer. The cymbals are centrally supported on a vertical spindle attached to the drum, with the first cymbal in fixed location above the second cymbal and an abutment, supporting the second cymbal, is in biased contact with the first cymbal, and slidingly received on the vertical spindle, and pivotal arm, spaced apart from the spindle and operable by motion of the drummer's arm, to move the second cymbal downward on the spindle, against the bias pressure, so that, upon release by the drummer of the first means, the bias pressure moves the second cymbal abruptly upward to crash against the first cymbal to make the appropriate high-hat sound.

U.S. Pat. No. 6,316,708 B1 to Kuppers describes a hi-hat that has available an operating unit with the aid of which the upper cymbal dish as well as the lower cymbal dish can be moved. The upper cymbal dish is for this reason allocated to a rod which can, as is well known, be moved downward in relation to the lower cymbal dish through the foot pedal. At the same time, the motion of the foot pedal is guided through a cable line and a guide pulley such that a sheath tube which bears the lower cymbal dish is moved in the reversed direction, that is, upward, through appropriate connections. Cylindrical springs and further safeties guarantee that overloading of the parts cannot occur.

U.S. Pat. No. 6,307,137 B1 to Liao describes an adjustable cymbal stand that comprises: a supporting frame clamped at a generic cymbal stand being provided with an upwardly extended positioning rod; a thread portion formed at a position near the bottom end of the positioning rod; a bearer unit for bearing an upper cymbal being screw-jointed with the positioning rod; the bearer unit having a supporting rod with a winged nut locked onto the positioning rod; a bearer unit for bearing a lower cymbal being located under the bearer unit for bearing the upper cymbal, and composed of a regulating seat, wherein a turn knob is protruded laterally on both sides of the regulating seat, a tapped hole is formed in center of the regulating seat for screw-jointing with the thread portion of the positioning rod, and a spiral spring is disposed under the regulating seat for propping against the latter. Moreover, the positioning rod is detachable from the supporting frame, wherein a sleeve with a tapped hole and a set bolt can be sleeve-jointed with top end of a generic cymbal stand as another option.

U.S. Pat. No. 5,367,939 to Barker describes a cymbal device for use with one hand that includes a shaft extending along an axis and two cymbals coaxially mounted on the shaft so that one of the cymbals is moveable relative to the other. A trigger mechanism is coupled to the shaft for displacing the moveable cymbal relative to the other cymbal to bring the cymbals into engagement with one another. A handle is secured to the shaft at a position enabling a user to grasp the handle and actuate the trigger mechanism with one hand.

U.S. Pat. No. 5,218,151 to Kurosaki describes the construction of a hi-hat cymbal holder for upper and lower cymbal plates, an extension rod that holds the upper cymbal plate is supported at its lower end by a bush in a holder unit, the lower cymbal plate is supported stationarily by the holder unit and a rotary ring of a gap adjuster nut is mounted to the holder unit so that its rotation causes up and down movement of the extension rod via the bush. For cymbal gap adjustment, the rotary ring is manually rotated in the opening or closing direction so as to move, via the bush and the extension rod, the upper cymbal plate with respect to the lower cymbal plate. The adjuster nut is located close to the position of a player during performance and its rotary ring can be easily operated by one hand of the player only without disturbing stick operation by the other hand.

U.S. Pat. No. 4,497,238 to Dasovich describes a reversible high-hat cymbal stand. The cymbal stand can be operated in a first mode of operation wherein the foot pedal or other actuator can be pressed downwardly to pull the upper cymbal into contact with the lower cymbal. In the second mode of operation the foot pedal or other actuator is connected to the lower cymbal which is normally biased upwardly into contact with the upper cymbal. Depression of the foot pedal causes the lower cymbal to become spaced apart from the upper cymbal. Removal of the drummer's foot causes the lower cymbal to be biased against the upper cymbal without need for the player to maintain foot contact.

Notwithstanding the prior art, the present invention is neither taught nor rendered obvious thereby.

SUMMARY OF INVENTION

The present invention is directed to a leg lever adjustment device for a hi-hat musical cymbals device to enable variable adjustment of spacing between an upper cymbal and lower cymbal without the need for hand or foot operation. It includes: a) a base support having a connector mechanism for attachment to a hi-hat cymbals device vertical tube for positioning below the upper and lower cymbals of the hi-hat cymbals device; b) a spring-biased cymbal arm having a first end and a second end, being rotatably attached to the base support at its first end, and having its second end positioned above the base support connector mechanism for movable positioning about at least a portion of the hi-hat cymbals device vertical tube and directly under a lower cymbal of a hi-hat; c) a spring having a top end and a bottom end, the bottom end being positioned on the base support, and the top end being positioned in the vicinity of the second end of the cymbal arm and under the cymbal arm so as to bias the cymbal arm upwardly; d) a leg lever connected to the cymbal arm, the leg lever including a vertical drop component and a lower outwardly extending leg press bar, the adjustment device and the leg lever having a rest position, wherein the spring is uncompressed, and a full press position, wherein the spring is fully compressed; wherein a user may attach the leg lever adjustment device to a hi-hat cymbals device with an upper cymbal and a lower cymbal and a stand with a vertical tube, on the vertical tube below its lower cymbal, such that, in the leg lever rest position, the cymbal arm pushes the lower cymbal upwardly toward or against the upper cymbal, and by the user pressing the leg lever with a leg, moves the lower cymbal down and away from the upper cymbal to alter impact sound, and further wherein the user may adjust the spacing between the upper cymbal and lower cymbal by leg press adjustment between the rest position and the full press position.

In some embodiments of the present invention leg lever adjustment device for a hi-hat musical cymbals device, the leg lever press bar includes a roller to reduce friction between the press bar and a user's leg.

In some embodiments of the present invention leg lever adjustment device for a hi-hat musical cymbals device, the leg lever drop component includes a telescopic vertical drop adjustment mechanism to accommodate users of different heights, leg lengths and seating heights.

In some embodiments of the present invention leg lever adjustment device for a hi-hat musical cymbals device, the adjustment device further includes a hand lever extending from the adjustment device and connected to at least one of the cymbal arm and the leg lever for alternative hand operation of the adjustment device.

In some embodiments of the present invention leg lever adjustment device for a hi-hat musical cymbals device, the base support connector mechanism includes a notched orifice and a closure component selected from the group consisting of a bolt, a wing nut, a driving clamp and a screw.

In some embodiments of the present invention leg lever adjustment device for a hi-hat musical cymbals device, the device further includes a lock for locking the cymbal arm and the base support together with the spring compressed to render it inoperable until the lock is released.

In some embodiments of the present invention leg lever adjustment device for a hi-hat musical cymbals device, the lock is a swing latch that is releasable in one movement.

In some embodiments of the present invention leg lever adjustment device for a hi-hat musical cymbals device, the adjustment device further includes a space adjuster connected to the cymbal arm and the base support for adjustment of spring travel and space between the cymbal arm and the base support when the leg lever is in its rest position.

In some embodiments of the present invention leg lever adjustment device for a hi-hat musical cymbals device, the base support and the cymbal arm are metal.

In some embodiments of the present invention leg lever adjustment device for a hi-hat musical cymbals device, the metal is aluminum.

The present invention also includes, in combination, a leg lever adjustment device and hi-hat musical cymbals device that includes variable adjustment of spacing between an upper cymbal and lower cymbal without the need for hand or foot operation. This combination includes: A) a hi-hat musical cymbals device that includes: a) a base stand; b) a vertical tube connected to the base stand, a vertical rod moveably connected to the vertical tube for up and down movement relative thereto and biasing means to bias said vertical rod upwardly; c) an upper cymbal connected to the vertical rod; d) a lower cymbal located below the upper cymbal and nested upon the vertical tube; e) a foot pedal connected to the base stand and functionally connected to the vertical rod, such that when the foot pedal is pressed, the rod is moved down and the upper cymbal is thereby pulled downwardly toward the lower cymbal to generate a percussion sound, and further includes and when the foot pedal is released from being pressed, the upper cymbal lifts up away from the lower cymbal: B) a leg lever adjustment device connected to the hi-hat cymbals device, that includes: a) a base support having a connector mechanism for attachment to the hi-hat musical cymbals device vertical tube for positioning below the upper and lower cymbals; b) a spring-biased cymbal arm having a first end and a second end, being rotatably attached to the base support at its first end, and having its second end positioned above the base support connector mechanism for movable positioning about at least a portion of the hi-hat cymbals device vertical tube and directly under the lower cymbal; c) a spring having a top end and a bottom end, the bottom end being positioned on the base support, and the top end being positioned in the vicinity of the second end of the cymbal arm and under the cymbal arm so as to bias the cymbal arm upwardly; d) a leg lever connected to the cymbal arm, the leg lever including a vertical drop component and a lower outwardly extending leg press bar, the leg lever having a rest position, wherein the spring is uncompressed and a full press position, wherein the spring is fully compressed; wherein a user may attach the leg lever adjustment device to a hi-hat with an upper cymbal and a lower cymbal and a stand with a vertical tube on the cymbal stand vertical tube below its lower cymbal such that in the leg lever rest position, the cymbal arm pushes the lower cymbal upwardly toward or against the upper cymbal, and by the user pressing the leg lever with a leg, pushes the lower cymbal down and away from the upper cymbal to alter impact sound, and further wherein the user may adjust the spacing between the upper cymbal and lower cymbal by leg press adjustment between the rest position and the full press position.

In some preferred embodiments of the present invention combination of a leg lever adjustment device and hi-hat musical cymbals device, the leg lever press bar includes a roller to reduce friction between the press bar and a user's leg.

In some preferred embodiments of the present invention combination of a leg lever adjustment device and hi-hat musical cymbals device, the leg lever drop component includes a telescopic vertical drop adjustment mechanism to accommodate users of different heights, leg lengths and seating heights.

In some preferred embodiments of the present invention combination of a leg lever adjustment device and hi-hat musical cymbals device, the device further includes a hand lever extending from the device and connected to at least one of the cymbal arm and the leg lever for alternative hand operation of the device.

In some preferred embodiments of the present invention combination of a leg lever adjustment device and hi-hat musical cymbals device, the base support connector mechanism includes a notched orifice and a closure component selected from the group consisting of a bolt, a wing nut, a driving clamp and a screw.

In some preferred embodiments of the present invention combination of a leg lever adjustment device and hi-hat musical cymbals device, the device further includes a lock for locking the cymbal arm and the base support together with the spring compressed to render it inoperable until the lock is released.

In some preferred embodiments of the present invention combination of a leg lever adjustment device and hi-hat musical cymbals device, the lock is a swing latch that is releasable in one movement.

In some preferred embodiments of the present invention combination of a leg lever adjustment device and hi-hat musical cymbals device, the device further includes a space adjuster connected to the cymbal arm and the base support for adjustment of spring travel and space between the cymbal arm and the base support when the leg lever is in its rest position.

In some preferred embodiments of the present invention combination of a leg lever adjustment device and hi-hat musical cymbals device, the base support and the cymbal arm are metal.

In some preferred embodiments of the present invention combination of a leg lever adjustment device and hi-hat musical cymbals device, the metal is aluminum.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Originally, musical cymbals were individual elements, one held in each hand, that were banged together to generate a percussion sound. Marching bands today often use these types of cymbals. Bands developed cymbals on stands to eliminate holding them when playing—using a drumstick to hit a single cymbal kept the drummers hands on the sticks, but diverted movement from the drum to the cymbal. Eventually, hi-hats were developed with foot pedals so that a drummer not only avoids holding cymbals, but also avoids hand drumstick cymbal percussion wherein the hi-hat is played by only foot movement. The present invention represents the next quantum development in cymbal evolution.

Thus, the present invention relates generally to a new type of hi-hat musical cymbals, and specifically to an adjustment device with variable spacing capabilities between an upper and lower cymbal. Importantly, the present invention device is primarily operated by lateral leg movement, keeping both the hands and feet of the drummer free to perform conventional drumming functions while simultaneously operating the present invention device and the hi-hat. The present invention leg lever adjustment device may be positioned at its rest position wherein the cymbals are together, at its fully compressed position, wherein the cymbals having maximum spacing, or anywhere in between these extremes, depending upon the movement and positioning of the drummer's leg against the leg lever. This allows for varying spacing and different sounds emanating therefrom—for the first time, offering a drummer cymbals with diverse notes or tones, created by adjustments made without the use of hands or feet, i.e. by knee or leg movement. Thus, the present invention device provides the drummer with the ability to alter the sound of the hi-hat cymbals when struck with a drum stick and adjustments are made by leg or knee. Further, the present invention device may be made and sold as a stand-alone device, for attachment to a hi-hat device or it may be a removable or integral component of a combination hi-hat device.

Figure 1:
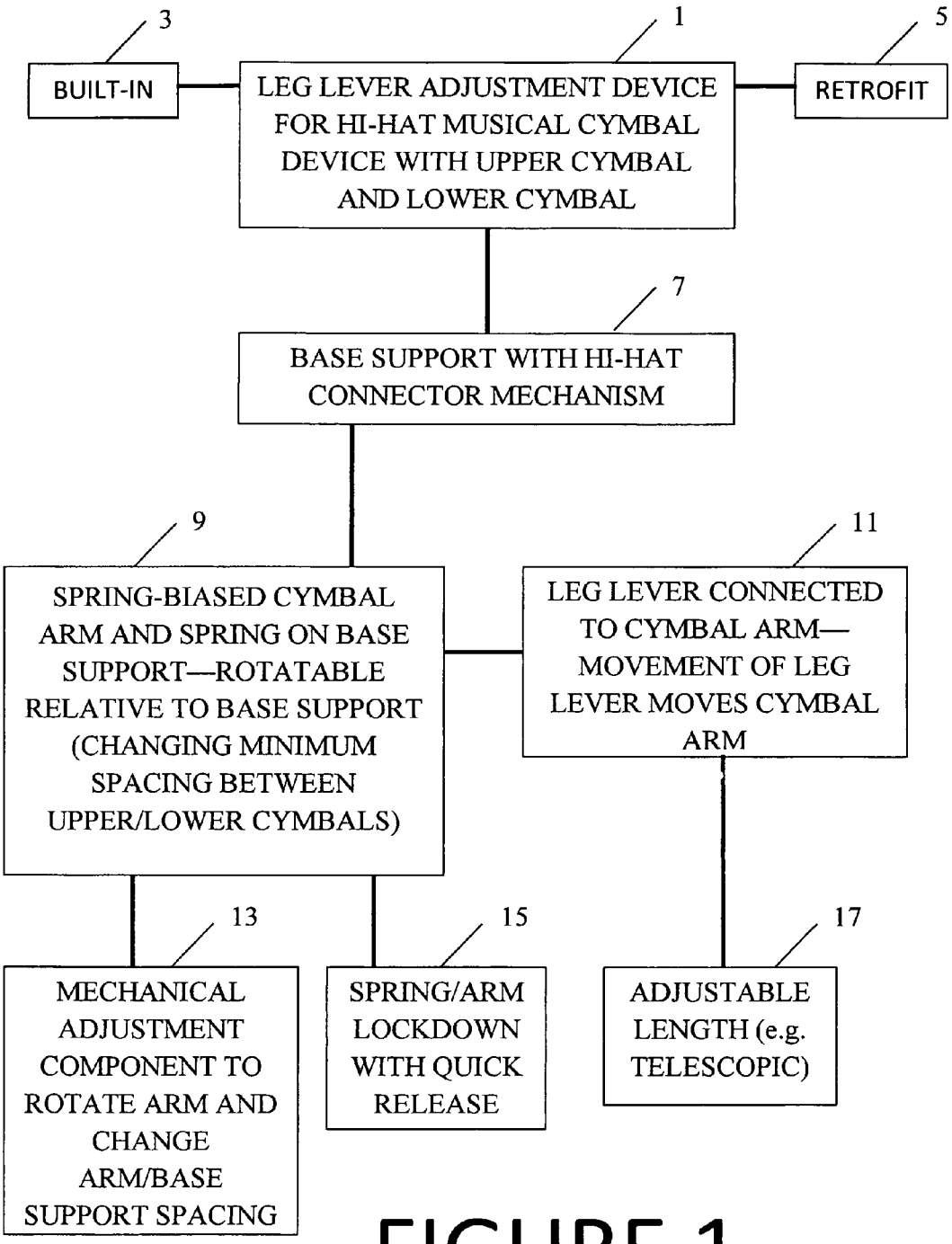
FIG. 1 is a block diagram of various embodiments of the present invention leg lever adjustment device as a retrofit device for, and also in combination with, hi-hat musical cymbals devices.

FIG. 1 is a block diagram of various embodiments of the present invention leg lever adjustment device as a retrofit device for, and also in combination with, hi-hat musical cymbals devices. Block 1 describes the leg lever adjustment device for the hi-hat musical cymbal device. In block 3, it is shown that the leg lever adjustment device from block 1 can be built-in, or, as shown in block 5, retrofitted. Block 7 of FIG. 1 describes the base support with the hi-hat connector mechanism. As shown in Block 9, the base support from block 7 includes a spring-biased cymbal arm and spring which is rotatable relative to the base support, changing spacing between the upper and lower cymbals. Block 11 in FIG. 1 depicts the leg lever being connected to the cymbal arm which moves as a result of movement of the leg lever. Block 13 shows a mechanical adjustment component to change the minimum space between upper and lower cymbals space of the spring-biased cymbals by changing the space of the spring-biased arm and spring on the bare support in block 9. Block 15 describes the spring/arm lockdown from block 9 having a quick release. Block 17 explains that the leg lever from block 11 has an adjustable length feature (e.g. telescopic). Before further explaining the details of the invention in conjunction with subsequent drawings, the following is a detailed explanation of a typical hi-hat cymbal device.

Figure 2:
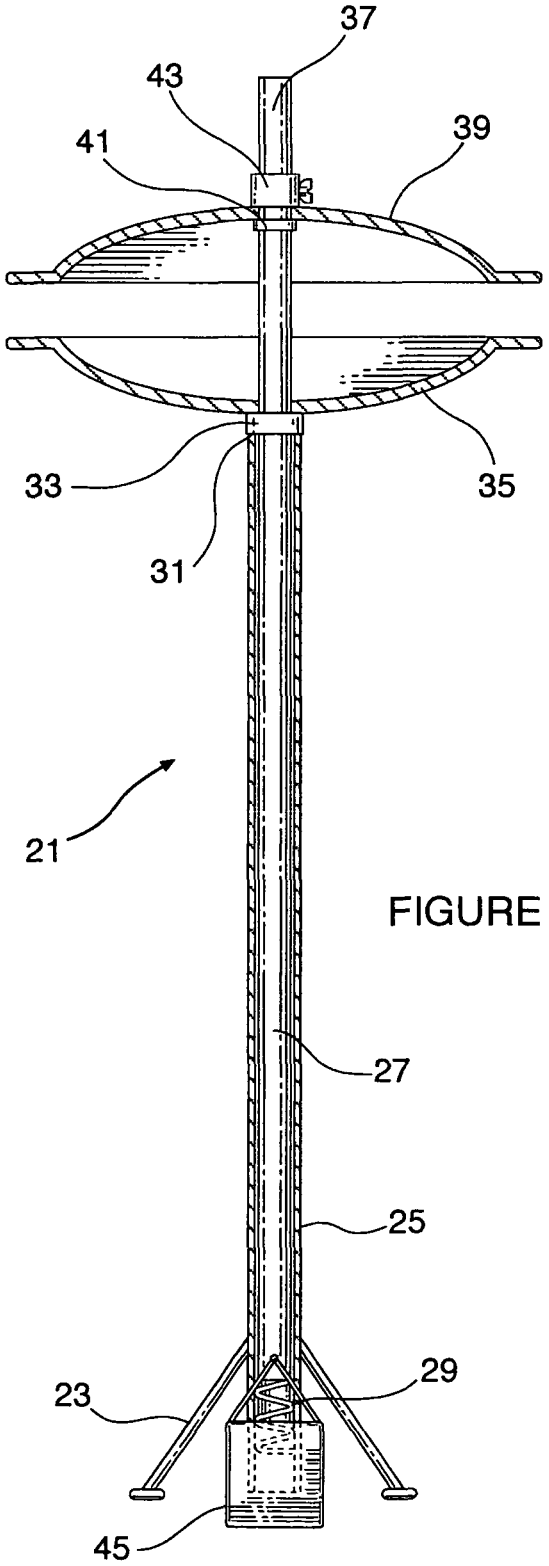
FIG. 2 is a front (facing a drummer view), partially cut view of a hi-hat musical cymbals device that may be used in combination with a present invention leg lever adjustment device.

FIG. 2 is a front (facing a drummer view), partially cut view of a hi-hat musical cymbals device that may be used in combination with a present invention leg lever adjustment device. Hi-hat musical cymbals device 21 is typical of such devices that utilize foot driven adjustment to keep drummers' hands free to drum while playing. Hi-hat cymbals device 21 includes a base stand 23, an outer hollow vertical tube 25 connected to said stand 23, and a biasing spring 29. The biasing spring 29 maintains internal vertical rod 27 in an upward position relative to outer hollow vertical tube 25, thereby maintaining upper cymbal 39 upward and away from lower cymbal 35. There is a stop 33 that maintains lower cymbal 35 in a stable position and upper cymbal stops 41 and 43 that are adjustable in height near the top 37 of vertical rod 27. When a drummer presses down with his foot on foot pedal 45, internal vertical rod 27 moves down, bringing upper cymbal 39 down to lower cymbal 35 to create a hands free adjustment for different drumming percussion action. However, if the drummer has two or more other foot adjusted devices, such as bass drums and cowbells then the drummer must stop one of those foot motions to put device 21 into use. The present invention leg lever adjustment device leaves the drummer's feet and hands free to perform other functions while at the same time adjusting the spacing and sound of a hi-hat musical cymbals device. Not only does the present invention free the hands and feet for adjustments, but creates controlled variable space relationships between the upper and lower cymbals and hence numerous sounds when the cymbals are struck with the drum stick.

Figure 3:
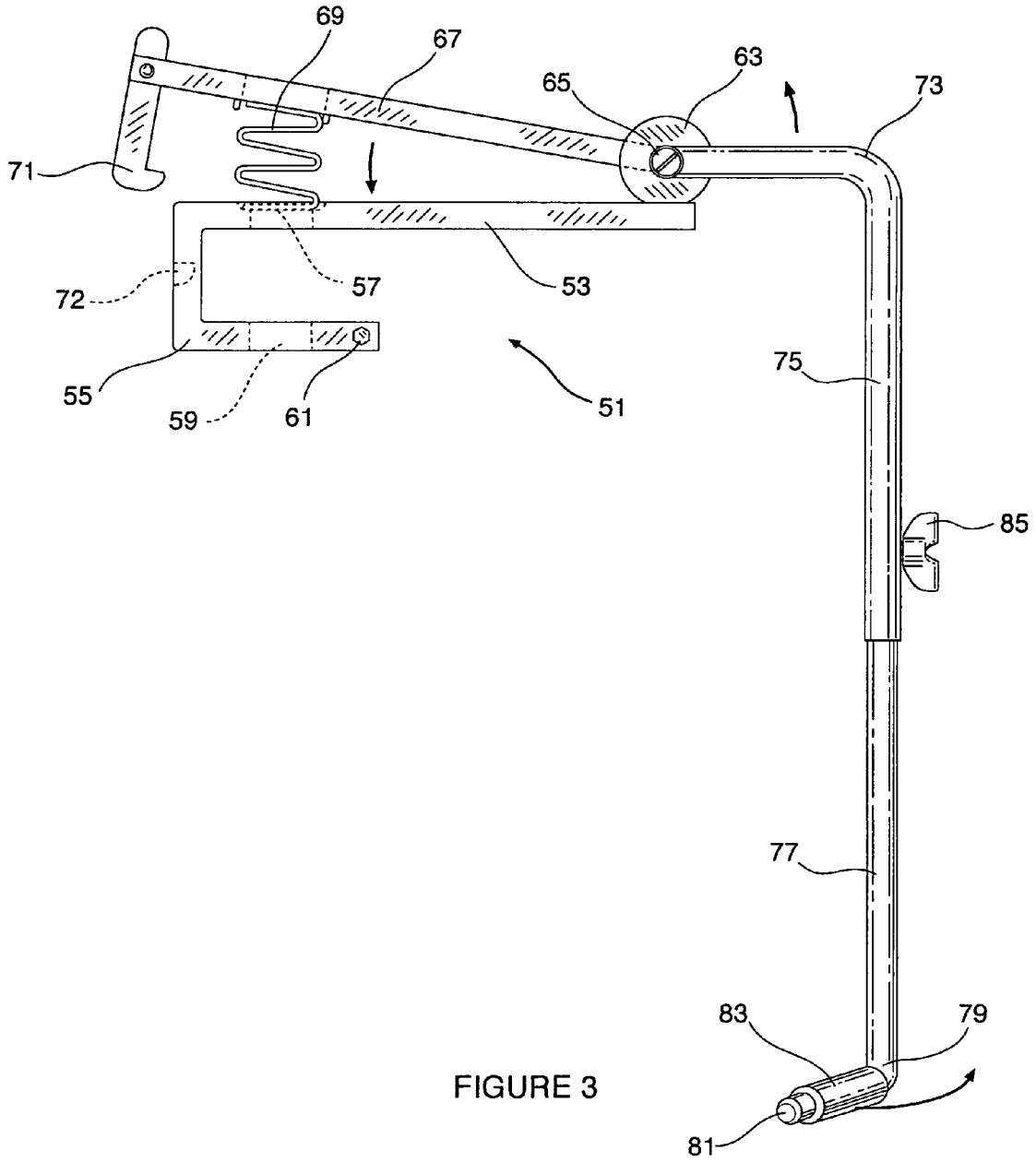
FIG. 3 is a front view of one embodiment of a present invention leg lever adjustment device for a hi-hat musical cymbals device.

FIG. 3 is a front view of one embodiment of a present invention leg lever adjustment device 51 for a hi-hat musical cymbals device 3. It includes a base support 53, having a connector mechanism (bolt and nut 61 operating with a cut bottom section 55 in conjunction with tube orifices 57 and 59) for attachment to a hi-hat cymbals device vertical tube for positioning below the upper and lower cymbals of a hi-hat cymbals device. There is also a spring-biased cymbal arm 67 having a first end and a second end, being rotatably attached to the base support 53 at its first end. The arm 67 also has a second end, positioned above the base support connector mechanism for movable positioning about at least a portion of a hi-hat cymbals device vertical tube and directly under a lower cymbal of a hi-hat. There is a spring 69 having a top end and a bottom end, wherein the bottom end is positioned on the base support 53, and the top end is positioned in the vicinity of the second end of the cymbal arm 67 and under the cymbal arm 67, so as to bias the cymbal arm upwardly. A leg lever 73 is connected to the cymbal arm 67, and it includes a vertical drop component 75 and a lower outwardly extending leg press bar 81 (with padding 83). The leg lever 73 also has, in this case, an adjustment mechanism. Here, there is a second piece to the vertical drop component 75, namely inner vertical drop lower section component 77 that, along with locking wing nut 85, allows for height adjustment to custom maximize leg positioning for drummers of different heights and/or seat arrangements. Leg lever 73 is connected to cymbal arm 67 and both are rotatably mounted on chock 63, a part of base support 53. Leg lever 73 has a rest position, wherein the spring 69 is uncompressed, and a full press position, wherein the spring 69 is fully compressed.

A user may attach said leg lever adjustment device 51 to a hi-hat cymbals device with an upper cymbal and a lower cymbal and a stand with a vertical tube, on said vertical tube below its lower cymbal. When connected in this manner, and the leg lever 73 is in its rest position, the cymbal arm 67 pushes the lower cymbal upwardly toward or against said upper cymbal. When a user presses the leg lever 73 with a leg, this moves the lower cymbal down and away from said upper cymbal to alter impact sound when the cymbal is struck with a drum stick. Further, a user may adjust the spacing between said upper cymbal and lower cymbal by leg press adjustment between said rest position and said full press position. This gives the user a broad variety of percussion sound adjustments without using hands or feet. When a user desires to bypass or inactivate the present invention leg lever adjustment device 51, swing leg lever 73 is pushed outwardly to its maximum and locking latch 71 locks into latch receiver 72 to keep the present invention leg lever adjustment device 51 in a clamped, inactive mode such that the hi-hat can be used as if the present invention leg lever adjustment device 51 was not present. The drummer reactivates the present invention leg lever adjustment device 51 by hitting the top of locking latch 71 with a drumstick and this releases arm 67 and spring 69 to return them to the functioning rest positions.

Figure 4:
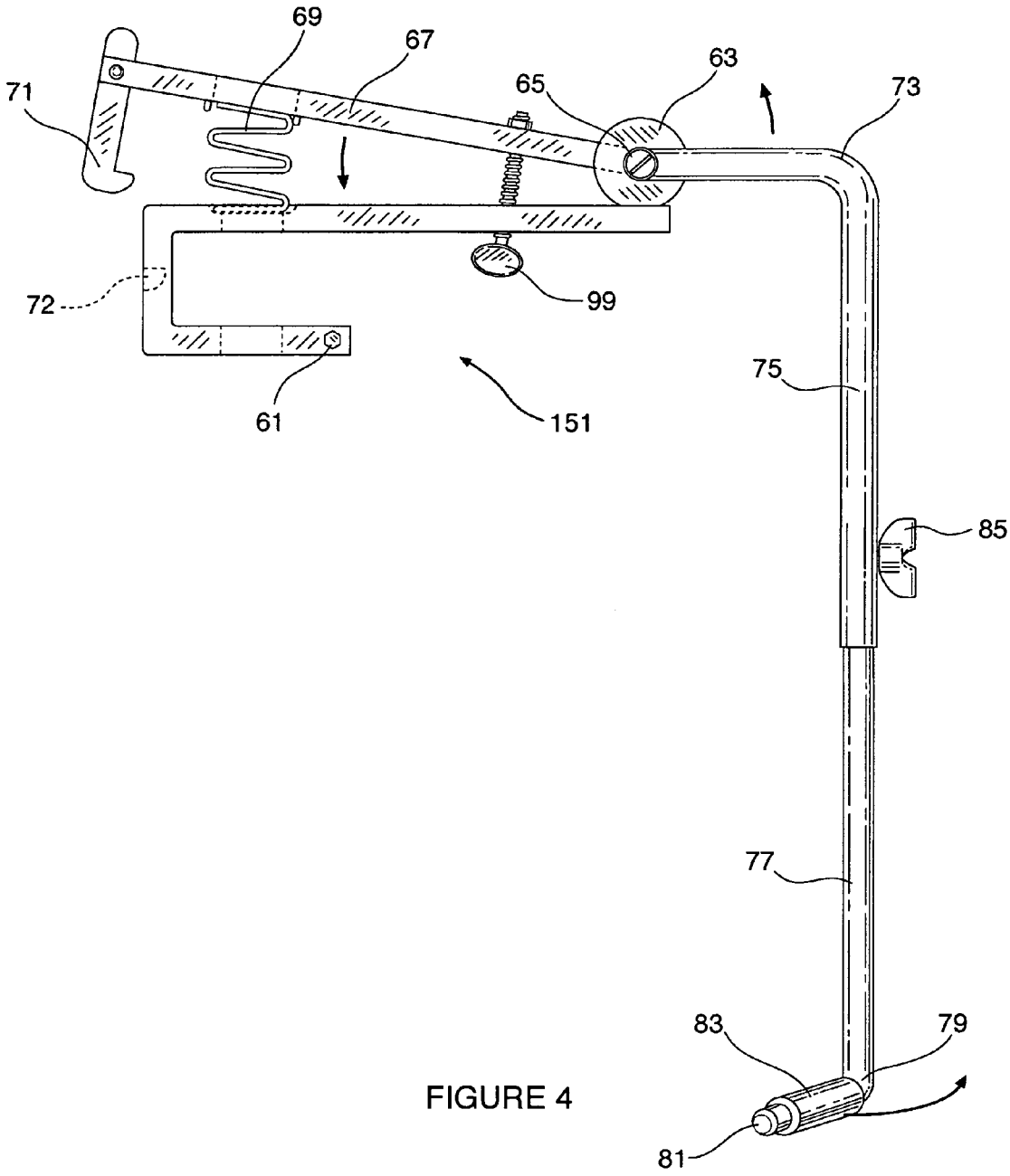
FIG. 4 is front view of another embodiment of a present invention leg lever adjustment device for a hi-hat musical cymbals device.

FIG. 4 is front view of another embodiment of a present invention leg lever adjustment device for a hi-hat musical cymbals device 151. Parts identical to the parts shown in the present invention leg lever adjustment device 51 of FIG. 3 above are identically numbered and need not be described again. This present invention device 151 differs from the one shown in FIG. 3 above in that it now includes an optional space adjustment locking mechanism, set screw 99, so that a user may change and preset the minimum spacing between the cymbals when the present invention device 151 is in use.

Figure 5:
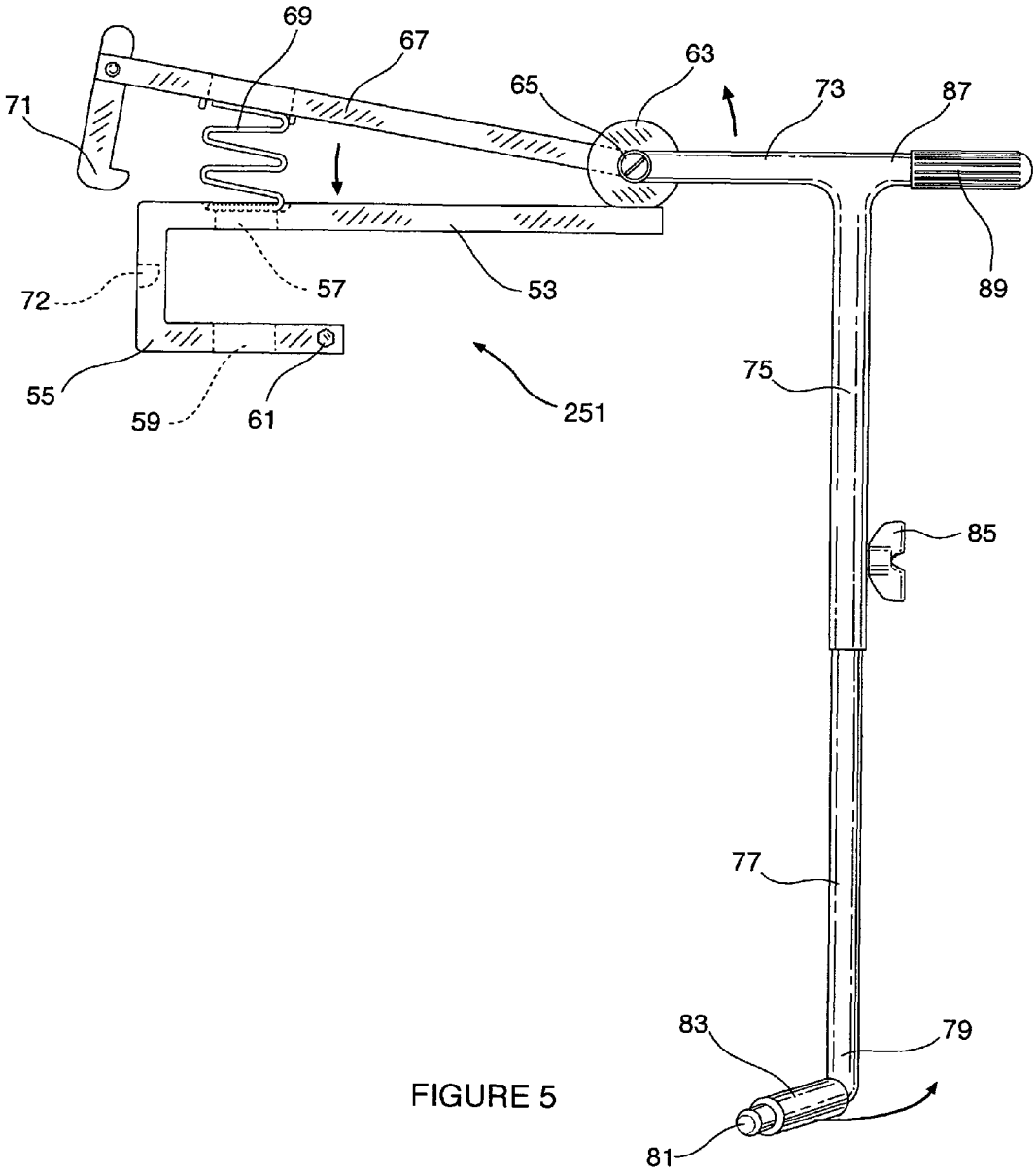
FIG. 5 is a front view of the embodiment of a present invention leg lever adjustment device shown in FIG. 3 above, but with a hand lever added for optional hand adjustment.

FIG. 5 is a front view of the embodiment of a present invention leg lever adjustment device shown in FIG. 3 above, but with a hand lever added for optional hand adjustment. Parts identical to the parts shown in the present invention leg lever adjustment device 51 of FIG. 3 above are identically numbered and need not be described again. This present invention device 251 differs from the one shown in FIG. 3 above in that it now includes a lateral extension that acts as a handle 87 (with grip 89) on the leg lever top so that a drummer may operate device 251 by leg or alternatively, by hand.

Figure 6:
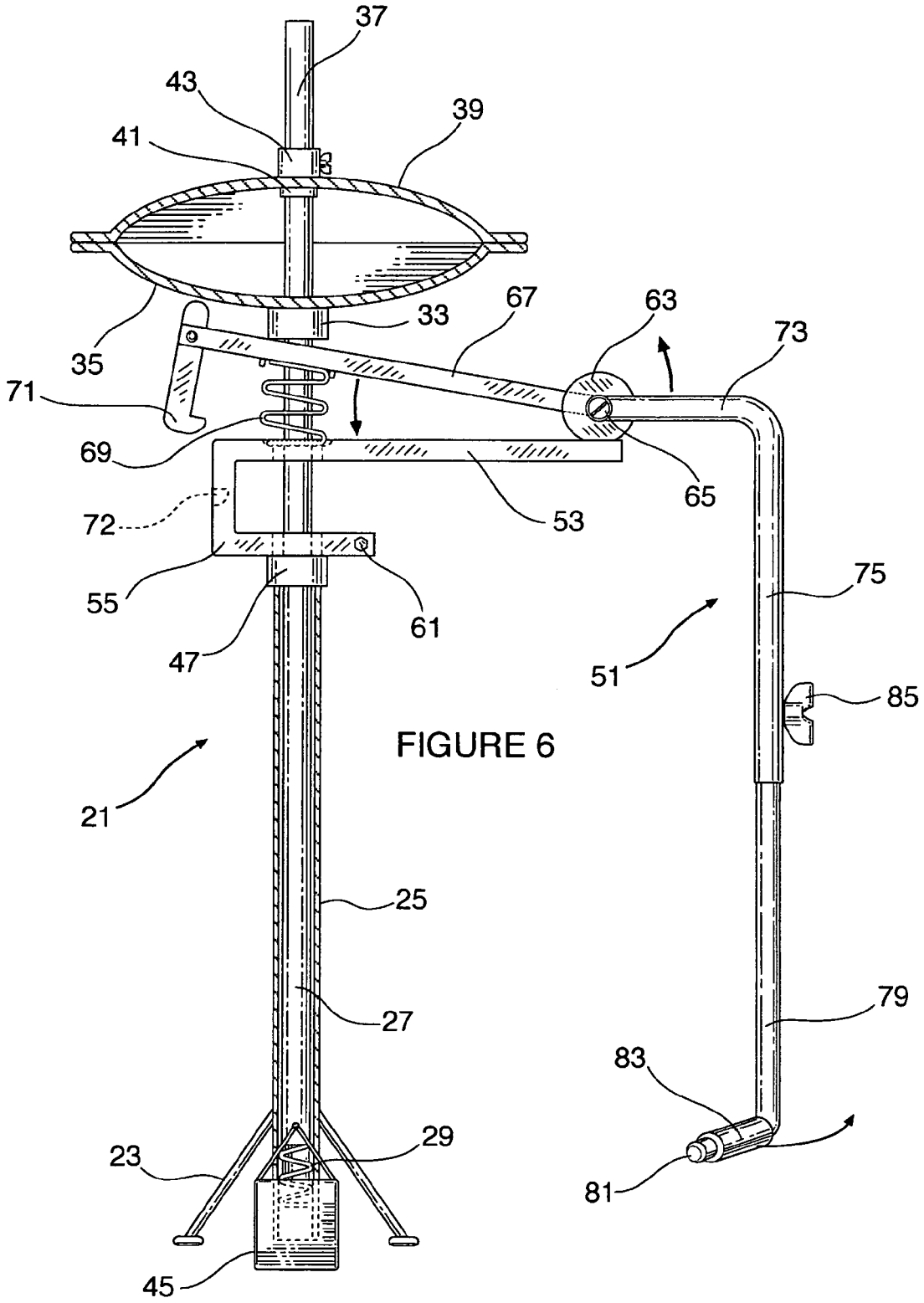
FIG. 6 is a front view of one embodiment of a present invention leg lever adjustment device for a hi-hat musical cymbals device in combination with the hi-hat, in its rest position.

FIG. 6 is a front view of one embodiment of a present invention leg lever adjustment device 51 (from FIG. 3 above) for a variety of hi-hat musical cymbals devices, but here specifically in combination with the hi-hat musical cymbals device 21 shown and described in FIG. 2, above, with present invention device 51 in its rest position. Parts identical to the parts shown in the present invention component hi-hat musical cymbals device 51 of FIG. 2 above are identically numbered and need not be described again. Likewise, parts identical to the parts shown in the present invention leg lever adjustment device 51 of FIG. 3 above are identically numbered and need not be described again. As mentioned spring 69 biases upwardly, creating a rest position wherein lower cymbal 35 is pressed up against upper cymbal 39.

Figure 7:
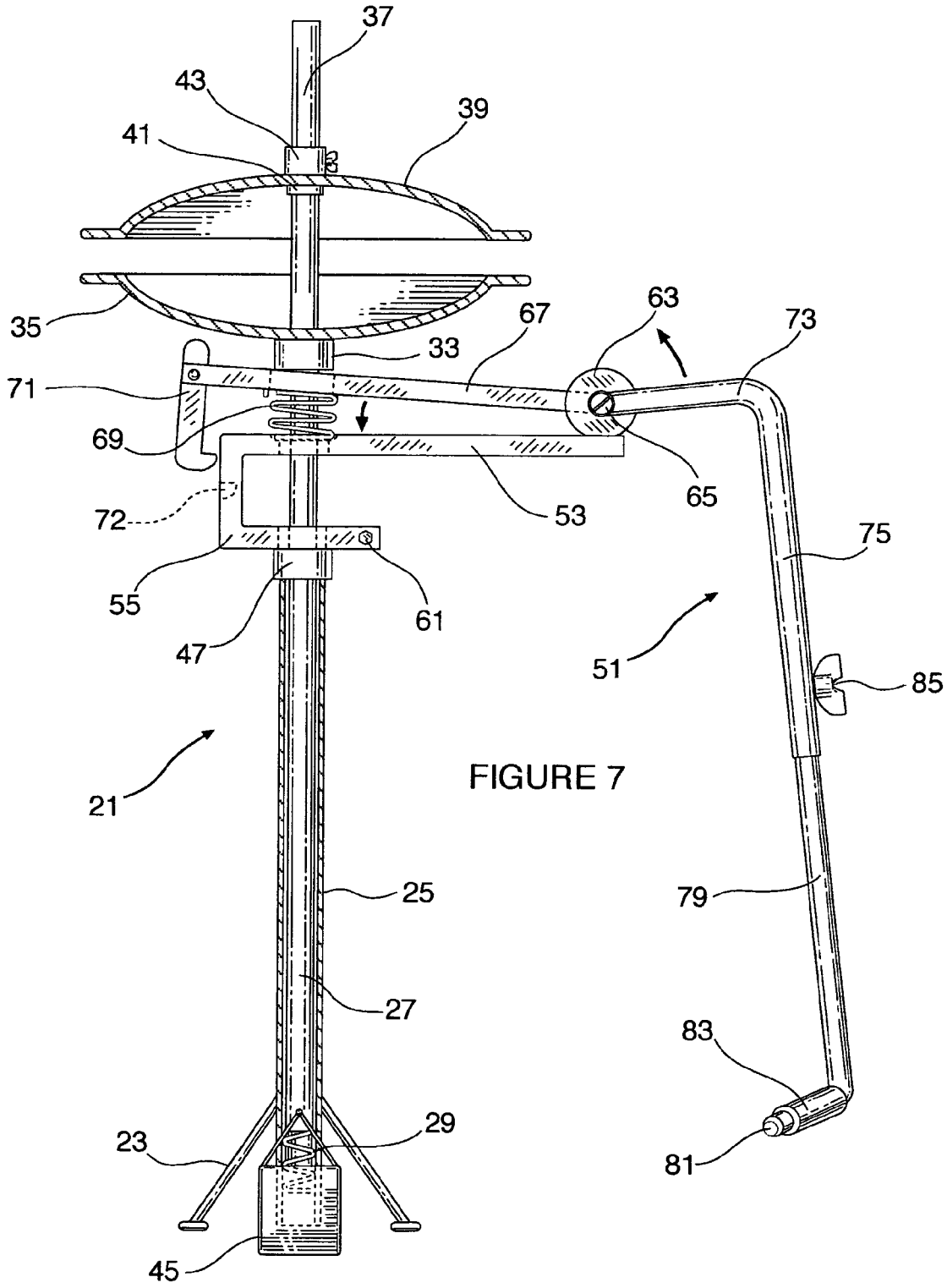
FIG. 7 is a front view of one embodiment of a present invention leg lever adjustment device for a hi-hat musical cymbals device in combination with the hi-hat shown in FIG. 6, in an open position while in use; and, FIG. 8 is a front view of one embodiment of a present invention leg lever adjustment device for a hi-hat musical cymbals device in combination with the hi-hat shown in FIG. 3, in its locked position.

FIG. 7 is based on FIG. 6 above, and is a front view of present invention leg lever adjustment device 51 in combination with the hi-hat musical cymbal device 21, as shown in FIG. 6, but with device 51 swung to the right by leg movement (leg not shown) in a partially open position for use. The user can move leg press bar 81 to right to any desired position within the range of closed to fully open to effect varying percussion sounds.

Figure 8:
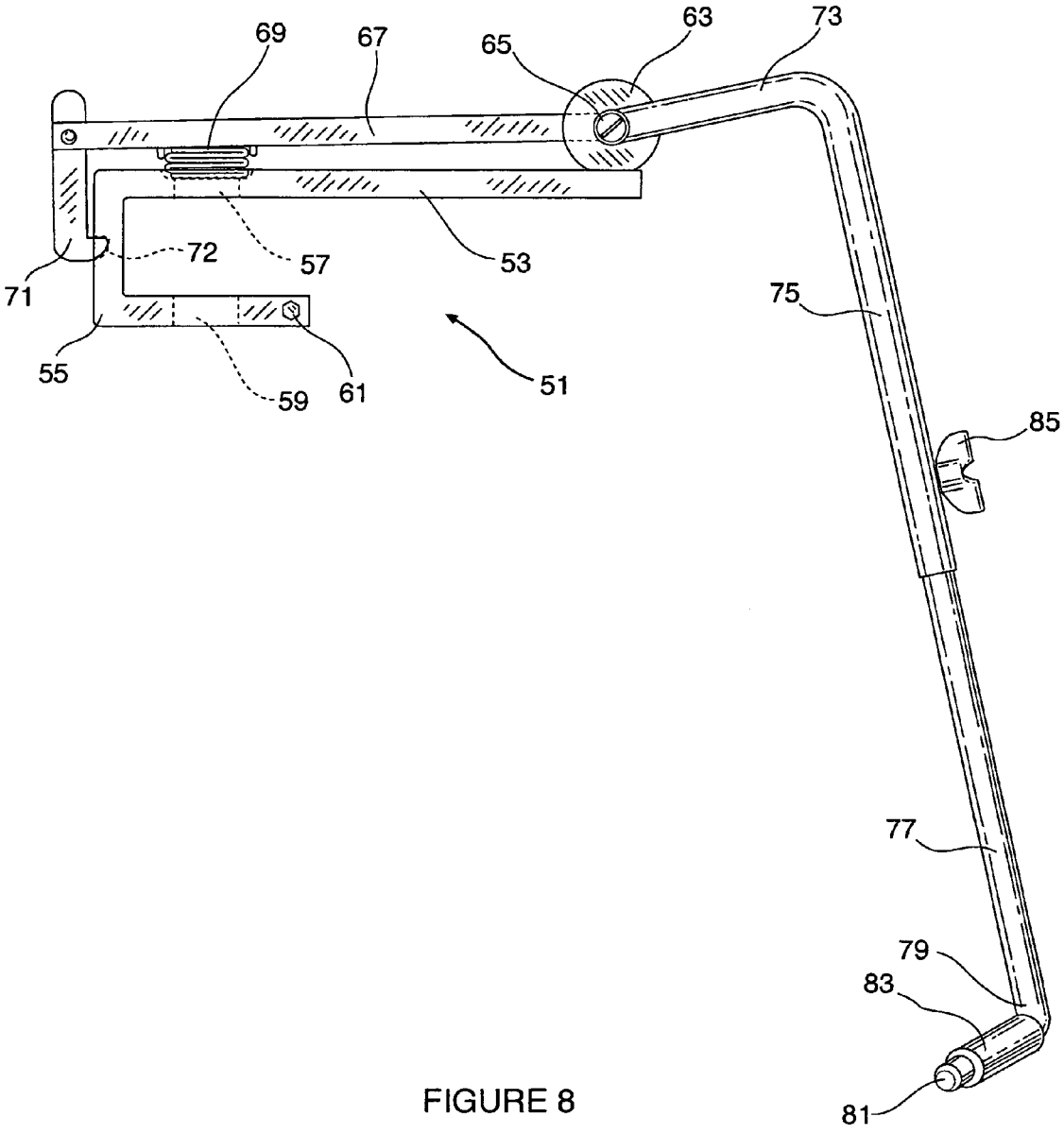

FIG. 8 is a front view of one embodiment of the present invention leg lever adjustment device 51 for a hi-hat musical cymbals device, shown in FIG. 3 above and elsewhere, and in this Figure is in its locked position. Parts identical to the parts shown in the present invention leg lever adjustment device 51 of FIG. 3 above are identically numbered and need not be described again. This present invention device 51 has arm 67 pressed fully downward and latch 71 is locked into receiver 72 to render it inoperable until latch 71 is released. When present invention device 51 inoperable, a hi-hat may be used in its conventional manner.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A leg lever adjustment device for a hi-hat musical cymbals device to enable variable adjustment of spacing between an upper cymbal and lower cymbal without the need for hand or foot operation, which comprises:

a) a base support having a connector mechanism for attachment to a hi-hat cymbals device vertical tube for positioning below the upper and lower cymbals of the hi-hat cymbals device;

b) a spring-biased cymbal arm having a first end and a second end, being rotatably attached to said base support at its first end, and having its second end positioned above said base support connector mechanism for movable positioning about at least a portion of said hi-hat cymbals device vertical tube and directly under a lower cymbal of a hi-hat;

c) a spring having a top end and a bottom end, said bottom end being positioned on said base support, and said top end being positioned in the vicinity of said second end of said cymbal arm and under said cymbal arm so as to bias said cymbal arm upwardly;

d) a leg lever connected to said cymbal arm, said leg lever including a vertical drop component and a lower outwardly extending leg press bar, said adjustment device and said leg lever having a rest position, wherein said spring is uncompressed, and a full press position, wherein said spring is fully compressed;

wherein a user may attach said leg lever adjustment device to a hi-hat cymbals device with an upper cymbal and a lower cymbal and a stand with a vertical tube, on said vertical tube below its lower cymbal, such that, in said leg lever rest position, said cymbal arm pushes said lower cymbal upwardly toward or against said upper cymbal, and by said user pressing said leg lever with a leg, moves said lower cymbal down and away from said upper cymbal to alter impact sound, and further wherein said user may adjust the spacing between said upper cymbal and lower cymbal by leg press adjustment between said rest position and said full press position.

2. The leg lever adjustment device for a hi-hat musical cymbals device to enable variable adjustment of spacing between an upper cymbal and lower cymbal without the need for hand or foot operation of claim 1, wherein said leg lever press bar includes a roller to reduce friction between the press bar and a user's leg.

3. The leg lever adjustment device for a hi-hat musical cymbals device to enable variable adjustment of spacing between an upper cymbal and lower cymbal without the need for hand or foot operation of claim 1, wherein said leg lever drop component includes a telescopic vertical drop adjustment mechanism to accommodate users of different heights, leg lengths and seating heights.

4. The leg lever adjustment device for a hi-hat musical cymbals device to enable variable adjustment of spacing between an upper cymbal and lower cymbal without the need for hand or foot operation of claim 1, wherein said adjustment device further includes a hand lever extending from said adjustment device and connected to at least one of said cymbal arm and said leg lever for alternative hand operation of said adjustment device.

5. The leg lever adjustment device for a hi-hat musical cymbals device to enable variable adjustment of spacing between an upper cymbal and lower cymbal without the need for hand or foot operation of claim 1, wherein said base support connector mechanism includes a notched orifice and a closure component selected from the group consisting of a bolt, a winged nut, a driving clamp and a screw.

6. The leg lever adjustment device for a hi-hat musical cymbals device to enable variable adjustment of spacing between an upper cymbal and lower cymbal without the need for hand or foot operation of claim 1, wherein said device further includes a lock for locking said cymbal arm and said base support together with said spring compressed to render it inoperable until said lock is released.

7. The leg lever adjustment device for a hi-hat musical cymbals device to enable variable adjustment of spacing between an upper cymbal and lower cymbal without the need for hand or foot operation of claim 6, wherein said lock is a swing latch that is releasable in one movement.

8. The leg lever adjustment device for a hi-hat musical cymbals device to enable variable adjustment of spacing between an upper cymbal and lower cymbal without the need for hand or foot operation of claim 1, wherein said adjustment device further includes a space adjuster connected to said cymbal arm and said base support for adjustment of spring travel distance and space between said cymbal arm and said base support when said leg lever is in its rest position.

9. The leg lever adjustment device for a hi-hat musical cymbals device to enable variable adjustment of spacing between an upper cymbal and lower cymbal without the need for hand or foot operation of claim 1, wherein said base support and said cymbal arm are metal.

10. The leg lever adjustment device for a hi-hat musical cymbals device to enable variable adjustment of spacing between an upper cymbal and lower cymbal without the need for hand or foot operation of claim 9, wherein said metal is aluminum.

11. A leg lever adjustment device and hi-hat musical cymbals device that includes variable adjustment of spacing between an upper cymbal and lower cymbal without the need for hand or foot operation, which comprises:

A) a hi-hat musical cymbals device that includes:

a) a base stand;

b) a vertical tube connected to said base stand, a vertical rod moveably connected to said vertical tube for up and down movement relative thereto and biasing means to bias said vertical rod upwardly;

c) an upper cymbal connected to said vertical rod;

d) a lower cymbal located below said upper cymbal and nested upon said vertical tube;

e) a foot pedal connected to said base stand and functionally connected to said vertical rod, such that when said foot pedal is pressed, said rod is moved down and said upper cymbal is thereby pulled downwardly toward said lower cymbal to generate a percussion sound, and when said foot pedal is released from being pressed, said upper cymbal lifts up away from said lower cymbal;

B) a leg lever adjustment device connected to said hi-hat cymbals device, that includes:

a) a base support having a connector mechanism for attachment to said hi-hat musical cymbals device vertical tube for positioning below said upper and lower cymbals;

b) a spring-biased cymbal arm having a first end and a second end, being rotatably attached to said base support at its first end, and having its second end positioned above said base support connector mechanism for movable positioning about at least a portion of said hi-hat cymbals device vertical tube and directly under said lower cymbal;

c) a spring having a top end and a bottom end, said bottom end being positioned on said base support, and said top end being positioned in the vicinity of said second end of said cymbal arm and under said cymbal arm so as to bias said cymbal arm upwardly;

d) a leg lever connected to said cymbal arm, said leg lever including a vertical drop component and a lower outwardly extending leg press bar, said leg lever having a rest position, wherein said spring is uncompressed and a full press position, wherein said spring is fully compressed;

wherein a user may utilize the combination with the said leg lever adjustment device attached to a hi-hat with an upper cymbal and a lower cymbal and a stand with a vertical tube on said cymbal stand vertical tube below its lower cymbal such that in said leg lever rest position, said cymbal arm pushes said lower cymbal upwardly toward or against said upper cymbal, and by said user pressing said leg lever with a leg, pushes said lower cymbal down and away from said upper cymbal to alter impact sound, and further wherein said user may adjust the spacing between said upper cymbal and lower cymbal by leg press adjustment between said rest position and said full press position.

12. The leg lever adjustment device and hi-hat musical cymbals device that includes variable adjustment of spacing between an upper cymbal and lower cymbal without the need for hand or foot operation of claim 11, wherein said leg lever press bar includes a roller to reduce friction between the press bar and a user's leg.

13. The leg lever adjustment device and hi-hat musical cymbals device that includes variable adjustment of spacing between an upper cymbal and lower cymbal without the need for hand or foot operation of claim 11, wherein said leg lever drop component includes a telescopic vertical drop adjustment mechanism to accommodate users of different heights, leg lengths and seating heights.

14. The leg lever adjustment device and hi-hat musical cymbals device that includes variable adjustment of spacing between an upper cymbal and lower cymbal without the need for hand or foot operation of claim 11, wherein said device further includes a hand lever extending from said device and connected to at least one of said cymbal arm and said leg lever for alternative hand operation of said device.

15. The leg lever adjustment device and hi-hat musical cymbals device that includes variable adjustment of spacing between an upper cymbal and lower cymbal without the need for hand or foot operation of claim 11, wherein said base support connector mechanism includes a notched orifice and a closure component selected from the group consisting of a bolt, a winged nut, a driving clamp and a screw.

16. The leg lever adjustment device and hi-hat musical cymbals device that includes variable adjustment of spacing between an upper cymbal and lower cymbal without the need for hand or foot operation of claim 11, wherein said device further includes a lock for locking said cymbal arm and said base support together with said spring compressed to render it inoperable until said lock is released.

17. The leg lever adjustment device and hi-hat musical cymbals device that includes variable adjustment of spacing between an upper cymbal and lower cymbal without the need for hand or foot operation of claim 16, wherein said lock is a swing latch that is releasable in one movement.

18. The leg lever adjustment device and hi-hat musical cymbals device that includes variable adjustment of spacing between an upper cymbal and lower cymbal without the need for hand or foot operation of claim 11, wherein said device further includes a space adjuster connected to said cymbal arm and said base support for adjustment of spring travel and space between said cymbal arm and said base support when said leg lever is in its rest position.

19. The leg lever adjustment device and hi-hat musical cymbals device that includes variable adjustment of spacing between an upper cymbal and lower cymbal without the need for hand or foot operation of claim 11, wherein said base support and said cymbal arm are metal.

20. The leg lever adjustment device and hi-hat musical cymbals device that includes variable adjustment of spacing between an upper cymbal and lower cymbal without the need for hand or foot operation of claim 19, wherein said metal is aluminum.

* * * * *